US005556553A

United States Patent [19]

Krulik et al.

[11] Patent Number: 5,556,553

[45] Date of Patent: Sep. 17, 1996

[54] RECYCLE PROCESS FOR REGENERATION OF AMMONIACAL COPPER ETCHANT

[75] Inventors: Gerald A. Krulik, San Clemente, Calif.; Nenad V. Mandich, Homewood, Ill.; Rajwant Singh, Fullerton, Calif.

[73] Assignee: Applied Electroless Concepts, Inc., San Clemente, Calif.

[21] Appl. No.: 447,752

[22] Filed: May 23, 1995

[51] Int. Cl.[6] ..... B44C 1/22; C23F 1/00

[52] U.S. Cl. ..... 216/93; 216/86; 216/105

[58] Field of Search ..... 216/84, 86, 93, 216/105; 252/79.5; 156/642.1

[56] References Cited

U.S. PATENT DOCUMENTS 4,915,776 4/1990 Lee ..... 216/93

*Primary Examiner*—William Powell

[57] ABSTRACT

A process for control of recycle of ammoniacal copper etchant which uses metallic aluminum to remove copper without substantially adding undesirable byproducts, by controlling the temperature and mixture rate of the removal process. The very rapid reaction can be controlled by using a diluent of copper-free etchant, heating to process temperature, then adding spent, copper containing etchant at a controlled rate while actively cooling the system to control the temperature. The copper concentration can be monitored by colorimetry while maintaining the pH above pH 8. The separated metallic copper and aluminum hydroxide sludge are easily filtered from the etchant. The purified etchant is now suitable for chemical adjustment and reuse.

11 Claims, No Drawings

RECYCLE PROCESS FOR REGENERATION OF AMMONIACAL COPPER ETCHANT

The present invention relates to a process for recycle of ammoniacal copper etchant which uses metallic aluminum to remove copper without substantially adding undesirable soluble byproducts. The reaction is fast and efficient, but difficult to control due to reaction speed and evolution of heat. An improved process uses a substantially copper-free ammoniacal etchant as the diluent for the recycle reaction. The reaction is operated at controlled temperature with monitoring and feedback of the copper content to give fast, efficient copper removal.

BACKGROUND OF THE INVENTION

The printed circuit board industry commonly uses ammoniacal alkaline copper etchant to remove unwanted copper from printed circuit boards as part of the fabrication process. One ammoniacal alkaline copper etchant is a mixture of copper ammonium chloride, ammonium chloride, ammonium hydroxide, ammonium carbonate, and small amounts of other materials. The copper ammonium chloride itself is the active etchant when the copper is in the cupric (+2) state. Cupric ammonium chloride attacks and dissolves metallic copper, forming cuprous (+1) ammonium chloride. The cuprous salt is inactive as an etchant material. Cuprous salts are reoxidized to the active etchant or cupric form by atmospheric oxygen.

This etchant is very widely used in printed circuit board production shops. The etch rate is very fast and the etch solution can hold large amounts of copper. After etching, the normal maximum loading of copper is 105–188 grams of copper per liter (14–25 ounces of copper per gallon). The solution, once loaded with copper, is not discarded. It is recycled and processed to remove the excess copper to yield fresh etchant and metallic copper.

The processes which are used for ammoniacal copper etchant regeneration in commercial recycling plants are complex and expensive. In one process, the spent etchant is contacted with a liquid ion exchange (LIX) material which is dissolved in a water immiscible organic solvent such as kerosene. This is normally a continuous process using countercurrent flow apparatus. The copper-loaded LIX/kerosene mixture is contacted with a sulfuric acid solution, also using countercurrent flow apparatus. The sulfuric acid extracts the copper from the LIX/kerosene mixture to regenerate the ion exchange material. The copper sulfate/sulfuric acid solution is used to produce low value copper sulfate crystals. Alternatively, the copper sulfate/sulfuric acid solution can be electrolyzed in an electrolytic plating cell to recover higher value metallic copper.

The amounts of spent alkaline etchant produced are very large. Typically one gallon of spent etchant is produced for every 7 to 10 square feet of double sided printed circuit material processed. Even a moderately large shop can produce over one hundred thousand gallons of spent etchant per year. Because the quantities of used ammoniacal etchant are very large and reclaim is very complicated, the used etchant is shipped off-site to recycling facilities. These large shipments of etchant are expensive and hazardous, affording numerous opportunities for hazardous materials spills.

Commercial alkaline etchant recycling facilities are very large and complex. They have multiple large countercurrent extraction flow towers containing large volumes of recirculating etchant, kerosene, hazardous organic complexing agents, sulfuric acid, and copper sulfate. All of these materials are toxic and hazardous in the event of a plant accident and chemical spill. The kerosene solution is also combustible and presents a continuous fire hazard. If copper reclaim is done by electroplating, very large rectifiers with high power consumption are needed.

Another known process for ammoniacal etchant purification uses a special electrolytic cell attached to the etch machine to remove the copper. This has stringent technical and chemical design limits. A two cell process with a membrane separator is often used. Direct electrolysis of ammoniacal copper etchant is not practical due to the presence of chloride, which gives chlorine gas on electrolysis. The etchant was chemically changed from a chloride based to a sulfate based system. This uses copper ammonium sulfate instead of copper ammonium chloride as the active, but much slower etchant. The slower etchant was also needed due to design limits on the speed of electrolytic recovery in this in-plant system to maintain the correct copper concentration for reproducible etching. The actual etching rate is about three times slower than with copper chloride based, ammoniacal alkaline copper etchants. Most printed circuit shops are at or near capacity on their ammoniacal etcher, often fully using them two or even three shifts a day. Thus they would have to triple their capital investment in expensive machines to use this process.

One new process which has been proposed uses metallic aluminum to remove the copper in a simple, one step reaction without the introduction of detrimental impurities and without the use of expensive membrane separators and rectifiers. This process is highly exothermic and difficult to control. In the present invention, an improved process which uses aluminum as the reductant has been developed, which gives simple and fast control of the copper reduction reaction.

SUMMARY OF THE INVENTION

The present invention relates to an improved method of ammoniacal etchant recycle which is less expensive, less hazardous, and much quicker than either the LIX/electrolytic process or the direct electrolysis process. This novel process utilizes metallic aluminum in a controlled reaction at a controlled temperature using a diluted spent etchant solution to directly produce both metallic copper and regenerated etchant. The process is suitable for use in relatively small recycle machines and can be used on-site. This can eliminate environmental hazards and costs of shipments of large amounts of hazardous liquids.

The improved process uses a quantity of substantially copper-free ammoniacal alkaline copper etchant as the diluent and moderator of the copper reduction by aluminum. The copper-free etchant is brought to a desired operational temperature prior to controlled addition of the copper-laden spent etchant. The temperature is controlled by cooling or heating, as needed, while the rate of copper removal may be monitored by colorimetric sensors or other means. The colorimetric sensor may also be used as an endpoint detector to signal the need for additions of aluminum metal. When the temperature of the system begins to drop, while the copper concentration is increasing, the aluminum needs replenishment. Excess solution can be removed continuously or batch wise, filtered to remove insoluble aluminum hydroxide and copper metal particles, and regenerated by chemical additions or reused directly. The pH should be maintained at or above pH 8.0 for most efficient operation.

Too low a pH slows the reaction for removal of copper. Too low a pH can also allow precipitation of ammonium chloride and copper ammonium chloride salts.

It is commonly known that a metal of greater electromotive force (EMF) will chemically reduce a dissolved metal of lesser electromotive force on contact. Cementation reactions, for example the formation of blister copper, are commonly used in the mining industry whereby acidic dilute copper solution is contacted with scrap iron. Some of the metallic iron dissolves and metallic copper is deposited on the remaining metallic iron.

It is also known that cementation reactions can occur in alkaline solutions. Since many metals have limited solubility in alkaline solution, such alkaline solutions commonly have chelating or complexing agents added to keep the metals in solution. This is the function of the ammonia in ammoniacal copper etchant, to keep the copper soluble.

Cementation reactions have been used to regenerate acidic ferric chloride (and sulfate) etchants used for copper etching. A copper-laden spent ferric chloride solution is contacted with metallic iron or steel. The copper will precipitate out on the metallic iron. Simultaneously some of the metallic iron will dissolve as ferrous chloride. After all the copper is removed, the solution is filtered, diluted with water and acid, and reused. The disadvantage is that the solid iron reductant dissolves in the solution. Thus for each unit of copper cemented out of solution, a chemically equivalent amount of iron dissolves and increases the amount of active etchant. Each time the etchant is regenerated, there is more active etchant. The excess must be disposed of, usually by waste treatment.

By experimentation it was found unexpectedly that cementation of copper ammoniacal etchant can proceed in a useful manner on aluminum metal. One of the key observations is that the cementation of copper onto aluminum must take place more quickly than the remaining cupric ammoniacal chloride etchant can attack the cemented copper. After the initial high copper concentration is reduced to a relatively low level and/or the temperature is reduced below the normal etch operating temperature, the system stops functioning as an effective etchant and the remainder of the copper precipitates out without being redissolved.

This observation would be of little utility for recycling if there were no other benefits. Normally, during the cementation reaction two things occur simultaneously. The soluble metal of lesser EMF is reduced to solid metal by the metallic element of greater EMF. At exactly the same time, the original solid metallic element goes into solution to replace the precipitated metal. If the higher EMF metal were zinc or iron, the two metals would go into solution as soluble zinc ammoniacal chloride or iron ammoniacal chloride. This means that the etchant, though cleaned of copper, would now contain another metal. This other metal would interfere with or prevent copper etching. Even if it did not, it would accumulate in the solution and allow only a small amount of recycling, as the solution would have to be discarded after one or more cementation steps.

Aluminum either as metallic aluminum or aluminum alloys and in the form of granules, lumps, turnings, sheet, foil, or ingots, can function as a regenerant without the limitations discussed above. Ammonia is used as the complexing agent in ammoniacal copper etchant, to maintain high concentrations of copper in solution. This same ammonia will also keep other metals such as iron or zinc, traditional cementation metals, in solution. However, aluminum does not form a complex with ammonia. In fact, ammonia can be used to precipitate aluminum from acidic solution. This means that aluminum can be used not only to cement out the copper, but also to purify itself from the solution. It is this self-purification aspect that is the most unique and useful part of the aluminum recycle process. Aluminum metal dissolves as $Al^{+3}$ ions as the copper is reduced to the metal. The $Al^{+3}$ ions then immediately react with the aqueous alkaline solution to form insoluble aluminum hydroxide. The etch solution thus is regenerated to a substantially pure solution of copper-free and aluminum-free ammoniacal etchant replenisher solution. The purified replenisher solution can then be reused as a copper etchant after pH and concentration adjustment. The combined precipitate of copper and aluminum hydroxide can be filtered off and each can be reclaimed separately.

The reaction is highly exothermic when aluminum and copper-laden etchant are mixed together. If sufficient aluminum is added in one step to react with and precipitate all the copper in a spent etchant solution, an uncontrolled reaction occurs with the solution boiling, often to dryness. The uncontrolled reaction leads to rapid depletion of ammonia by evaporation, change of solution concentration, and uncontrolled precipitation of unreduced copper salts.

The reaction can be easily controlled if a sufficient quantity of substantially copper-free etchant is brought to the desired operating temperature, followed by controlled addition of copper-containing spent etchant. The reaction can be maintained at the desired process temperature by standard feedback controls of heater, cooler, and rate of addition of the copper-laden spent etchant. The aluminum can be present in the form of a large excess relative to the amount of copper to be removed, eliminating problems with programmed additions of aluminum. This would allow replenishment of the aluminum at infrequent intervals, making the process more commercially attractive. The colorimeter can be used to signal the exhaustion of the aluminum metal, by stopping the reaction if the copper concentration continues to increase.

DETAILED DESCRIPTION OF THE PREFERRED EMBODIMENTS

Although the following description is detailed and specific, the process described here is merely illustrative of the invention. Anyone skilled in the art can utilize this concept to develop many procedures in addition to those shown in the examples.

Test solutions were spent ammoniacal copper etchant from a commercial printed circuit shop. This material (Ultraetch 50, MacDermid, Inc.) is typical of the spent ammoniacal etchant commercially available. As received, the pH of the spent etchant is 8.2–8.8 with approximately 120–188 grams of copper per liter. Etchant starter solution is substantially identical with used ammoniacal etchant, except for a slightly lower copper concentration of 100–125 grams per liter. The etchant uses cupric ammoniacal chloride as the active etchant, so etchant starter solution must contain copper. Etchant replenisher solution is substantially free of copper. The material safety data sheet (MSDS) for etchant replenisher lists ammonium chloride, 10–25 weight percent and ammonium hydroxide, 20–40 weight percent; pH 9–10. The replenisher is mixed with used etchant to maintain a desired pH, specific gravity, and copper content for useful etching. For Ultraetch 50, the suggest pH range is 8.2–8.8, working specific gravity is 1.20–1.22, and the copper content of spent etchant is between about 120 and 188 grams per liter.

The desired amount of aluminum can be added to the substantially copper-free fresh etchant or etchant replenisher solution prior to heating or cooling, or after heating or cooling. Once the desired temperature is attained, copper laden spent etchant is added at a controlled rate. The temperature increases as the copper reduction reaction occurs, so sufficient cooling and control of the copper addition rate must be used to maintain the temperature within the desired range. Once the addition of copper laded spent etchant is discontinued, the solution temperature will begin to drop as the copper is precipitated. Amounts of copper can be economically removed to a final amount of less than 0.5 g/l by maintaining a sufficiently high process temperature and sufficient aluminum metal to react with all of the copper.

In general the rate of removal of copper from the spent etchant is controlled by the surface area of the aluminum, the acceptable operating temperature, and the amount of cooling available to remove waste heat. The copper precipitation reaction becomes uneconomically slow when the temperature is controlled below about 40° C. Temperatures above about 90° C. give excessive losses of ammonia by evaporation. Within the range of 40° C. to 90° C., the preferred temperature range is about 60° C. to 75° C. Any method of cooling may be used to maintain the solution temperature within the desired range.

The following examples illustrate the process.

EXAMPLE 1.

Thirty eight liters of substantially copper free ammoniacal etchant replenisher solution was pumped into a polypropylene process tank having a sloped bottom, bottom drain to a filter press, and a recirculation loop to the tank. The tank contained a fluorocarbon coated stainless steel heater and a fluorocarbon tube coil water cooler. 11,612 surface $cm^2$ (12.5 surface square feet) of aluminum plates, in the form of ten 24 cm ×24 cm×0.32 cm (9.5"×9.5"×0.125") panels weighing 4888 grams was placed in the tank. The panels were held in a rack to allow free movement of solution against the panels. A stirrer was used to mix the solution.

The solution was heated to 60° C. Spent copper laden etchant was slowly pumped into the tank while cooling to maintain the temperature at about 60° C. to 75° C. Over a period of 2.33 hrs, 4 gallons of spent etchant was added. Two liters of aqueous ammonia was added after the first hour. The reaction was allowed to continue for a further half hour while allowing the solution to cool. The pH was maintained between pH 8.5 and 9.76 during the reaction.

A sample was checked and found to have 0.41 g/l copper. The solution was filtered with a filter press to give a clear, light blue solution suitable for recycle and reuse as ammoniacal copper etchant. The filter press cake consisted largely of aluminum hydroxide after washing and blow-down. The copper fines accumulated in the bottom of the process tank and on the aluminum sheet. The amount of copper recovered was measured, as was the amount of aluminum used. The reaction efficiency was about 94% based on reduction of copper (II) salts, giving 3.3 g (theory 3.5 g) of copper removal per gram of aluminum. The total amount of aluminum used was 728 grams.

The filtered solution was adjusted to pH of 8.5 with ammonia. It was colorless when first filtered, showing that the copper residue was in the colorless $Cu^{1+}$ state. This solution turned pale blue on standing in contact with air, as the cuprous ions were re-oxidized to colored cupric ions. The residual aluminum was less than 40 mg/l. This purified solution was mixed with etchant starter solution in a 1:5 ratio and gave normal copper etch rates.

EXAMPLE 2.

The same experimental set-up as Example 1 was used. Initial volume was 57 liters of nearly copper-free replenisher containing <0.4 g/l copper. The solution was heated to about 70° C. A rack containing 10 sheets of aluminum, 24 cm×24 cm×0.32 cm, total 11,612 surface $cm^2$ with mass 4893 g, was inserted into the solution.

Spent copper-laden etchant containing 130 g/l copper was pumped into the solution at a rate of 1.25 liters/min. The spent etchant was at room temperature (about 20° C.), and exerted a cooling effect on addition. The rate of copper addition was controlled by turning the pump on or off while monitoring the temperature. Cooling was used as needed to keep the temperature below about 75° C. Electrical heating was used only to establish the initial temperature. Further heating was due to the reaction of copper and aluminum. Table I shows the experimental details.

One liter of spent etchant was added by hand to start, followed by a further 4 liters. All further spent etchant was pumped in at 1.25 l/min. In the 57 liters starting solution, each minute of pumping increased the copper concentration by about 2.86 g/l. Table I also shows the cumulative additions of copper versus the measured amounts remaining in solution.

Total time of reaction was 2 hrs 20 min. A total of 77.3 g/l copper was added, based on the initial 57 liters of copper-free solution. A total of 5 liters of spent etchant was added by hand to start. This was followed by periodic pumping for a total of 23 minutes which added 28.75 l (7.6 gal) of additional spent etchant. The total weight of copper removed in this time was 4387 g Cu (9.66 lbs).

The starting specific gravity was 1.01 and 1.040 at the end. The pH was 9.34 at the end versus 9.84 to start. The weight of the panels after use was 4071 g, giving a consumption of 822 g of aluminum. The amount of copper removed was 5.34 gram of copper per gram of aluminum. This shows a large direct reduction from the $Cu^{1+}$ state, since $Cu^{2+}$ gives 3.5 grams of copper per gram of aluminum, while $Cu^{1+}$ gives 7 grams per gram of aluminum. The efficiency was 152%, based on only on $Cu^{2+}$ reduction.

TABLE I

EXAMPLE 2.

| Time, min | T, °C. | Remarks |
|---|---|---|
| 0 | 67.8 | Added 1 L Cu Solution |
| 2 | 67.2 | Sampled (+2.29; measured 2.05 g/l Cu) |
| 6 | 66.6 | |
| 6.5 | 66.5 | Sampled; no visible change. Measured 2.1 g/l. |
| 9 | | Added 4 L Cu Solution in 1.5 min. Reaction has |
| 10.5 | | visibly begun. Total 11.44 g/l Cu added, or 652 g Cu. |
| 11 | 64.2 | |
| 12.5 | 65 | Sampled. Measured 9.875 g/l. |
| 21 | 71.7 | pH 9.84 |
| 26 | 73.6 | Sampled. Measured 2.25 g/l Cu. |
| 35 | 72 | |
| 36 | 71.8 | Sampled; pH 9.63. Measured 0.645 g/l Cu. |
| 40 | 70.8 | |
| 43 | 69.9 | Pump run for 1 min. 1.25 L |
| 44 | 69.2 | added. Total 14.3 g/l Cu added (815 g Cu). |
| 47 | 68.5 | |

TABLE I-continued

EXAMPLE 2.

| Time, min | T, °C. | Remarks |
|---|---|---|
| 47.5 | | Another 1.25 L. Total 17.2 g/l Cu added (980 g Cu). |
| 50 | 67.7 | |
| 53 | 68.3 | |
| 55 | 67.1 | Another 1.25 L. Total 20.0 g/l Cu added (1140 g Cu). |
| 58 | 69.3 | |
| 62 | 71.7 | Sampled. Measured 2.17 g/l Cu. |
| 63 | 72.8 | Cooling on low |
| 64 | 72.7 | |
| 65 | 73.2 | |
| 67 | 71.5 | |
| 70 | 69.4 | Sampled. Measured 0.99 g/l Cu. |
| 75 | 60.6 | Cooling still on |
| 76 | 59.2 | Pump on for 3 min |
| 79 | 51.3 | Total 3.75 L added. Total 28.6 g/l Cu (1630 g Cu) added. |
| 80 | 50.6 | Cooling off |
| 82 | 49.7 | Sampled. Measured 4.25 g/l Cu. |
| 84 | 52.2 | Pump on for 4 min |
| 88 | 52.2 | Total 5 L added. Total 40.0 g/l Cu (total 2280 g Cu) added. |
| 89 | 54.2 | Switched to new Cu drum |
| 91 | 57.3 | Pump on for 4 min |
| 95 | 61.8 | Pump off; 5 L added; Sampled. Total 51.6 g/l Cu (2941 g Cu) added. 4.63 g/l Cu measured. |
| 96 | 62.7 | Pump on for 9 min. |
| 105 | 67.8 | Pump off; 11.25 L added; still no cooling. 77.3 g/l Cu (4406 g Cu) added. |
| 107 | 69.1 | |
| 110 | 71.6 | Sampled. Measured 2.34 g/l Cu. |
| 114 | 72.6 | Cooling on very low |
| 116 | 69.8 | Cooling off |
| 119 | 72.4 | |
| 120 | 71.2 | Sampled. Solution not bubbling vigorously, most Cu gone. Measured 0.467 g/l Cu. |
| 121 | 71.3 | Solution whitish cloudy; turns blue on standing |
| 130 | 70.7 | Sampled. Measured 0.275 g/l Cu. |
| 140 | 68.2 | Cooling water on high for shut down |
| 145 | 64.5 | Solution nearly colorless after standing. pH 9.34. Measured 0.167 g/l Cu. |
| Over-night | Stand-ing | Measured 0.105 g/l Cu. Al plates had been removed. |

EXAMPLE 3.

The same experimental set-up as the above example was used. The purpose of this experiment was to investigate the maximum practical addition rate of spent ammoniacal copper etchant, using the cooling system experimentally available. Initial volume was 66 liters (17.5 gal) of nearly copper-free replenisher containing 0.1 g/l copper. The solution was heated to about 70° C.

The aluminum sheets had been used once before, the deposited copper removed, and the sheets were now lightly oxidized. Any residual copper on the aluminum was expected to shorten the initiation time for copper deposition. The aluminum plates were 4 sheets of 24 cm×24 cm×0.32 cm; plus 10 thinner used sheet, 2 per slot on the rack, for a total of 14 sheets. The overall total mass was 2874 g. Weight of panels after use was 1752 g. The surface area of the panels was 580 $cm^2$ for each side, neglecting the edges; or a total of about 16240 surface $cm^2$ (17.5 $ft^2$) of surface area.

Spent copper-laden etchant containing 130 g/l copper was pumped into the solution at a rate of 2.4 liters/min, giving an increase of 4.7 g Cu/min. The etchant was at room temperature, so exerted a cooling effect on addition. The rate of copper addition was controlled by turning the pump on or off while monitoring the temperature. Cooling was used as needed to try to maintain the temperature below circa 75° C. Electrical heating was used only to set the initial temperature. Further heating was due to the reaction of copper and aluminum. Table II shows the experimental details, including the cumulative additions of copper versus the measured amounts remaining in solution.

The total time of the reaction was 27 minutes before uncontrollable heating and boil-over occurred. A total of 68.2 g/l copper was added in 14.5 minutes of pumping, based on the initial 17.5 gallon of copper-free solution. (total adds were 34.8 liters of spent etchant). The total weight of copper added in this time was 4524 g Cu=9.96 lbs.

Most of the boil-over was recovered in an overflow tank. This contained approximately 20 liters of solution with 29.6 g/l Cu. Thus 1960 g Cu was left in this solution, and 2560 g Cu was removed in the 27 minutes before boil-over.

The remainder in the tank after overflow to holding tank plus some spill to floor was about 38 L. This had almost no copper (<0.1 g/l) left after cooling and final removal of the aluminum plates. Thus an additional ~1100 g Cu was removed during cooling.

The aluminum consumption was 1122 g, to give 3660 g of copper removal. This was 3.26 gram of copper per gram of aluminum. This 93% efficiency shows the undesirable effect of uncontrolled heating, as compared with Example 2.

TABLE II

EXAMPLE 3.

| Time, min | T, °C. | Remarks |
|---|---|---|
| 0 | 69.1 | |
| 1 | 68.0 | Pumping started at 10 setting = 2.4 L/min |
| 2 | 65.1 | Added +4.7 g/l Cu (310 g Cu). |
| 3 | 64.3 | +9.4 g/l (620 g Cu). |
| 4 | 62.4 | +14.1 g/l (930 g Cu) |
| 5 | 61.7 | +18.8 g/l (1240 g Cu). |
| 6 | 61.5 | +23.5 g/l (1550 g Cu). |
| 7 | 62.6 | +28.2 g/l (1860 g Cu). |
| 8 | 64.7 | +32.9 g/l (2170 g Cu). |
| 9 | 68.0 | Pump off at 9.5 min, 69.2° C. ~+35.2 g/l Cu (2323 g Cu). Switched pails. |
| 10 | 68.6 | New pail, pump on. |
| 10.5 | 71.1 | Cooling on low. |
| 11 | 72.1 | +40 g/l Cu (2640 g Cu). |
| 12 | 71.1 | +44.7 g/l Cu (2950 g Cu). |
| 12.5 | 73.6 | Increased cooling flow. +49.4 g/l Cu (3260 g Cu). |
| 13 | 67.8 | Cooling off. Cleaned thermocouple. +54 g/l Cu (3564 g Cu). |
| 15 | 70.5 | +58.8 g/l Cu (3880 g Cu). |
| 15.5 | | Cooling on low. +63.5 g/l Cu (4190 g Cu). |
| 16 | 71 | Pump off. +68.2 g/l Cu (4500 g Cu). |
| 18 | 74.6 | Increased cooling to maximum. |
| 22 | 80.7 | pH 9.84 |
| 22.5 | | Added 2 liters cold water to system. |
| 23 | 81.1 | Trying to run filter press. Bottom port clogged. |
| 24 | 83 | |
| 27 | >95 | Sampled; boiled over. Overflow drum measured 29.6 g/l Cu vs total of 68.2 g/l added. Cooled solution next day had <1 g/l Cu in the main tank. |

What is claimed is:

1. A process for the purification of spent ammoniacal alkaline copper etchant containing more than about 100 g/l copper in solution which comprises the steps of:

a) Bringing fresh ammoniacal copper etchant containing less than 100 g/l copper to an operating temperature, between 40° C. and 90° C.;

b) Physically contacting the fresh ammoniacal etchant with a quantity of aluminum metal;

c) Mixing spent ammoniacal etchant containing dissolved copper with the fresh etchant at a controlled rate while monitoring the temperature of the resulting mixture;

d) Controlling the temperature of the mixture at operating temperature using cooling and heating to maintain the temperature of the mixture between 40° C. and 90° C.;

e) Maintaining the pH of the mixture above 8.0 by additions of ammonia to the mixture;

f) Separating substantially copper-free ammoniacal etchant solution from the metallic copper and aluminum hydroxide precipitates formed by reaction of aluminum metal and dissolved copper in the mixture;

g) Reconstituting fresh ammoniacal etchant by additions to reconstitute the pH, specific gravity, and chemical composition of the separated etchant solution.

2. A process according to claim 1 wherein said operating temperature is between 60° C. and 75° C.

3. A process according to claim 1 wherein colorimetry is used to measure the amount of copper in said mixture.

4. A process according to claim 3 wherein said measurement of copper is used to control the rate of addition of spent etchant.

5. A process according to claim 3 wherein said measurement of copper is used to control the addition of aluminum to fresh etchant.

6. A process according to claim 1 wherein said aluminum metal includes aluminum and aluminum alloys.

7. A process according to claim 1 wherein said aluminum metal is in the form of granules, lumps, turnings, scrap, sheet, foil, or ingots.

8. A process according to claim 1 wherein the pH of said mixture is maintained by the addition of ammonia gas or aqueous ammonium hydroxide.

9. A process according to claim 1 wherein said reconstituted fresh etchant is reused for additional copper etching.

10. A process according to claim 3 wherein the copper concentration is maintained between 0.1 and 40 g/l.

11. A process according to claim 4 wherein the copper concentration is most preferably maintained between 0.5 and 10 g/l.

* * * * *